United States Patent [19]

Berman

[11] 4,014,521

[45] Mar. 29, 1977

[54] DIVIDER NET WITH REPLACEABLE BOTTOM PANEL

[76] Inventor: Alan M. Berman, 949 Sutton Drive, Northbrook, Ill. 60062

[22] Filed: Sept. 29, 1975

[21] Appl. No.: 617,418

[52] U.S. Cl. ..... 256/1; 273/29 B; 256/24

[51] Int. Cl.[2] ..... E04H 17/00; A63B 61/00

[58] Field of Search ..... 293/29, 30, 29 B, 29 AB, 293/29 BD, 29 BC; 135/15 CF, 14 V, DIG. 7; 2/DIG. 2; 160/330; 256/24, 1

[56] References Cited

UNITED STATES PATENTS

| | | | |
|---|---|---|---|
| 2,500,074 | 3/1950 | Hill | 160/330 |
| 2,615,715 | 10/1952 | Moore | 273/29 B |

*Primary Examiner*—Werner H. Schroeder
*Assistant Examiner*—Doris L. Troutman
*Attorney, Agent, or Firm*—Laff, Whitesel & Rockman

[57] ABSTRACT

A divider net has an upper portion with a replaceable lower panel attached thereto. The panel is attached to the upper portion by means of fasteners which do not have to be aligned, and yet which reliably and securely bind the upper portion to the panel at many closely spaced points. In one embodiment, the fasteners are hook and loop strips having connect straps periodically spaced around them. In another embodiment, lacing may replace the connect straps. The lacing may run longitudinally along the strip; or it may be in the form of individual tie lines. In yet another embodiment, a zipper is used to attach the lower panel to the upper portion.

16 Claims, 6 Drawing Figures

DIVIDER NET WITH REPLACEABLE BOTTOM PANEL

This invention relates to divider nets and more particularly — but not exclusively — to divider nets for sports events, such as those played on indoor courts.

There are many places where light weight nets are required, especially to protect against flying balls or other objects. One example of such a place is found in indoor tennis courts, where a number of playing areas are located in a side-by-side relationship. A difficulty is that out-of-bound balls tend to fly across and players sometimes run across neighboring courts. Therefore, it is conventional to hang inter-court curtains from cables extending between playing areas. This way, the curtains catch flying balls and players encounter the nets.

A difficulty is that the inter-court nets must reach the floor and the bottom 3–6 inches simply lay in folds on the floor, in order to stop rolling balls. This means that the players will also step on the bottoms of the nets, sometimes while running at high speeds. Also, when it becomes necessary to clean under the nets, the maintenance crews tend not to be overly careful and to run cleaning equipment into the nets. Therefore, the bottoms of the nets quickly tend to become worn or torn. Hence, inter-court nets tend to be very expensive, relative to the costs of other equipment used in similar locations.

At first blush, it would appear that the solution is to make the bottoms of the inter-court nets of a stronger material. Thus, efforts have been made to replace the lower 2 feet or so, wear-prone section of the inter-court nets with a stronger material, such as solid panels of sheeting material reinforced with plastic. This does substantially increase the life time of the nets; however, it also causes problems since the players tend to fall when they step on these reinforced sheets because there is no give. Also, the player tends to skid or slide when he steps on the panel. Thus, the mere substitution of a solid panel for the bottom of the inter-court net is not a satisfactory solution.

As the inter-court net hangs, it tends to stretch — especially when players repeatedly run into it. Therefore, if an attempt is made to add a new and unstretched panel to an old stretched net curtain, the fasteners used to interconnect the two parts do not mate. If an effort is made to avoid the fasteners which have to mate, as by lacing the new bottom panel to the old net curtain, a substantial amount of labor is required.

Still another consideration is the general utility of the device. If the attachment of the bottom panel is subject to easy disconnection, it may come off and trip a player. If the fastener is a loose lacing, a player could snag it. Therefore, any solution to the problem must also be one having a general utility.

For convenience of expression, the term "net" is used generically herein to cover all materials which may be used for the intended purpose, without regard to how open or solid the netting may be or to the material which may be used to make the net.

Accordingly, an object of the invention is to provide new and improved divider nets. In this connection, an object is to provide such nets having particular utility for use on athletic playing fields. Here, it is an object to provide such nets for use between tennis courts and especially between indoor tennis courts.

A further object of the invention is to provide divider nets having replaceable panels. Here, an object is to provide such nets with fasteners having utility to add a new panel even after the existing curtain has stretched substantially. A further object is to provide such a replaceable panel which reliably remains attached to the existing curtain, even when a player collides with the net while running at high speed.

In keeping with an aspect of the invention, the above and other objects are accomplished by providing a divider net having an upper portion and a replaceable lower panel. The panel is attached to the upper portion by means of fasteners which do not have to be aligned, and yet which reliably and securely bind the upper portion to the panel at many closely spaced points. In one embodiment, the fasteners are hook and loop strips having connect straps periodically spaced around them. In another embodiment, lacing may replace the connect straps. The lacing may run longitudinally along the strip. Or it may be individual tie lines. Zippers may also be used.

The nature of preferred embodiments for accomplishing these and other objects may become more apparent from a study of the attached drawings wherein:

FIG. 1 schematically shows four adjoining tennis courts with three of the inventive divider nets between them;

FIG. 1 illustrates the invention wherein two walls 20, 21 represent a gymnasium or other room for enclosing a plurality of tennis courts (here four indoor tennis courts 22–25) or other suitable playing areas, such as for volley ball, badminton, practice golf, basketball, or the like.

Figure 1:
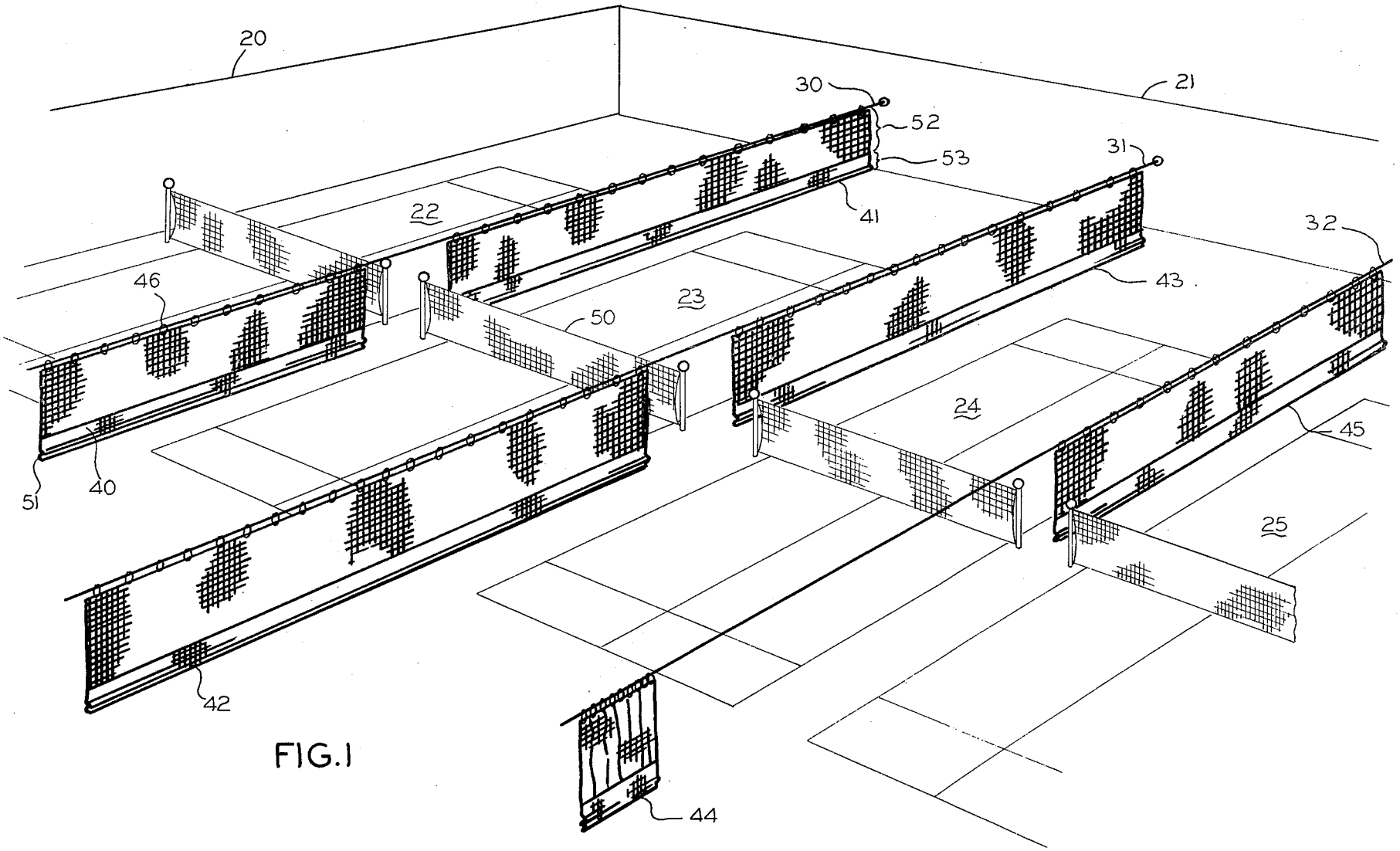

A cable 30–32, preferably steel, is stretched between each court. Hanging from each of the cables is one or more inter-court divider nets 40–45. These nets may be attached to the cables in any suitable manner, such by C-shaped members 46 (FIG. 2) closed by individually associated leaf springs 47, for example. For dividing indoor tennis courts, it is conventional to provide two such nets 40, 41, with an opening between them in the area of the playing net, as at 50. Usually the nets 40–45 are stretched for playing; however, they may also be pulled back (as at 44) for cleaning or the like.

The inter-court divider nets usually are long enough to reach down to and drape over the floor, with 3–6 inches of folding (as shown at 51). This way, any balls rolling along the floor are entrapped by the net. As a result, the net rubs against the floor when it is drawn back, when a player runs into it, when maintenance crews clean the floor, or the like. Of course, the net also receives substantial wear when a player steps down hard or falls upon a vertical section of the net. Therefore, the bottoms of the inter-court divider nets quickly wear out, in the lower few feet or wear-prone areas.

According to the invention, this wear problem is solved by providing two inter-court divider net sections 52, 53. The bulk of the divider net is in the upper area 52. The wear-prone part of the net is in a panel extending along the lower 2-feet-or-so part 53. Thus, the invention provides means for removing and replacing this wear-prone part.

Figure 3:
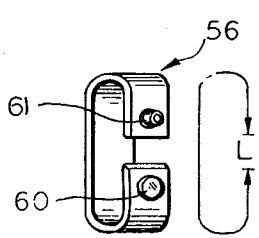
FIG. 3 is a perspective view showing a single fastener which is used in FIG. 2.
Figure 2:
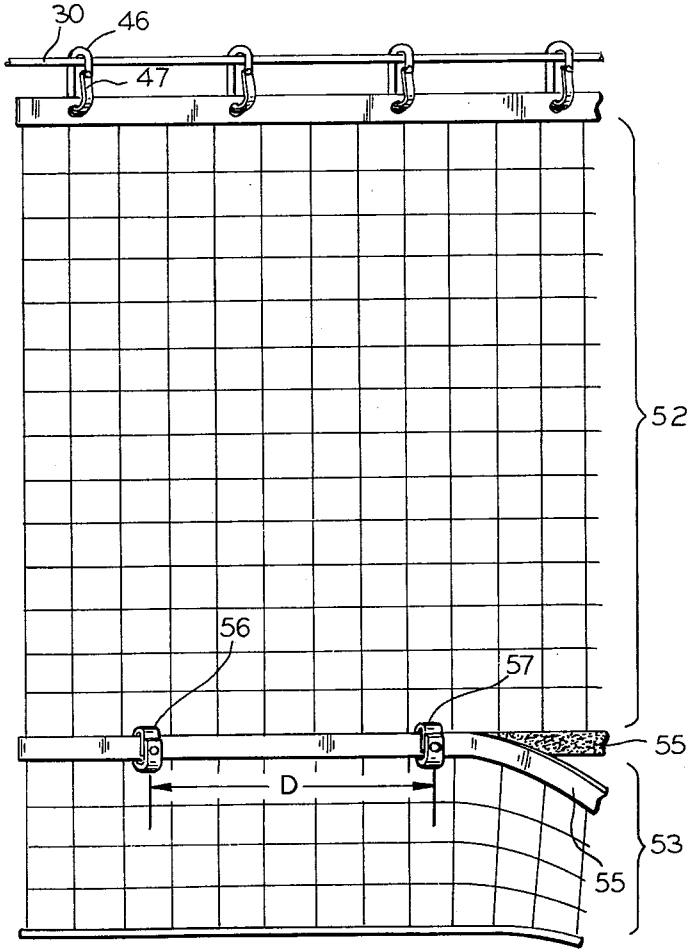
FIG. 2 is a plan view which shows the principle of a first embodiment of an inventive fastening method.

In the embodiment of FIGS. 2, 3, the bottom of part 53 and the top of part 52 terminate in face-to-face strips of fastening material 55, such as hook and loop material, sometimes sold under the trademark "VELCRO". Periodically wrapped around the hook and loop fastener strip is a plurality of mechanical joining means in the form of connect straps 56, 57.

Each connect strap (FIG. 3) has a length L, approximately equal to the distance around the hook and loop strip 55. The strap terminates on its ends in a snap 60 and a post 61, which together form a snap fastener. Therefore, each connect strap may be wrapped around the hook and loop strips 55 and snapped in place. This way, the hook and loop fasteners will not come apart for any distance greater than the distance D between adjacent connect straps.

Figure 4:
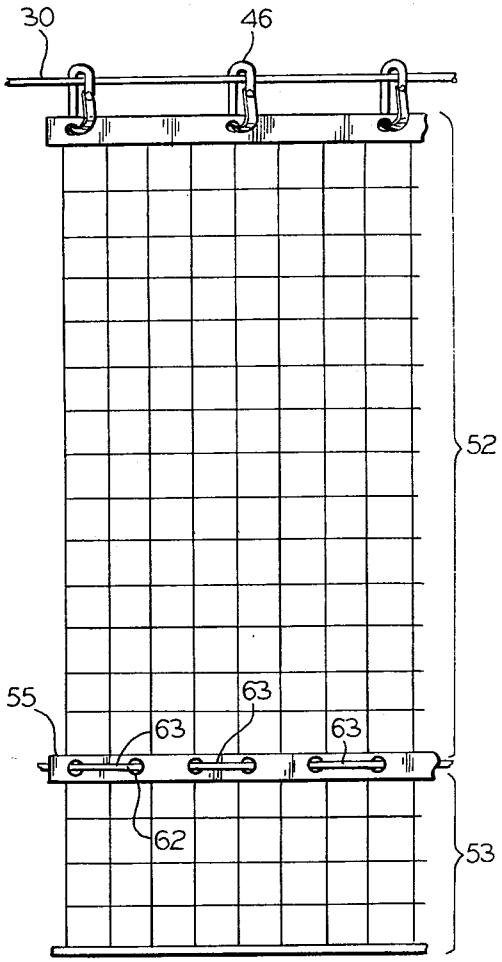
FIG. 4 is a plan view which shows the principles of a second embodiment of an inventive fastening method.

As shown in FIG. 4, the connect straps may be replaced by lacing. In greater detail, the hook and loop strips 55 have grommets 62 formed therein. The holes in grommets 62 are large enough so that there may be a substantial mismatch between the openings in the bottom of the upper part 52 and the top of lower part 53. Thereafter, a lacing 63 (not unlike a long shoe lace) is threaded through the grommets thereby mechanically joining together the hook and loop strips 55. It is easy to reach through net openings to complete the lacing. This way, the hook and loop strips cannot be pulled apart for any distance greater than the distance between adjacent grommets.

Figure 5:
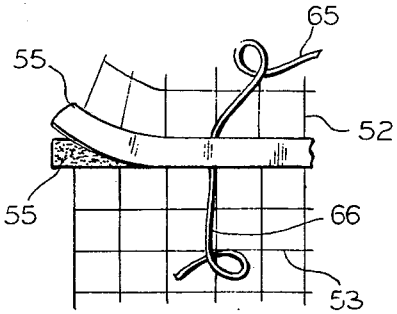
FIG. 5 is a fragmentary view of another embodiment showing a single tie fastener means.

In the embodiment of FIG. 5, a periodic series of ties 65, 66 are sewed between the hook and loop strips 55, 55 and the net material. This way, the hook and loop strips may be pressed together. Then the mating ties 65, 66 may be tied together to mechanically join together the strips 55, 55. This way, the ties limit the length of the hook and loop strips which may be pulled apart, much as the connect straps limit such length to the distance D (FIG. 2).

The advantages of the invention should now be apparent. The bottom net part or panel 53 may be removed and replaced on site, without having to remove the upper part 52 from the cable 30. The hook and loop fastener means 55, 55 extends incrementally along the entire length of the net, thereby providing a great mechanical strength owing to the uniformly distributed loading. The mechanical joining devices 56, 57, 63, 65, 66 limit the distance over which the hook and loop fasteners may separate if they should be inadvertently pulled apart.

While the invention is not necessarily limited to any particular style, size, or the like, it is particularly attractive for use with indoor tennis courts. There, the nets are very often in the order of 10 to 12 feet high and 60 feet long. There may be two or more separate sections in each 60-foot length, according to owner preference. In nets of these dimensions, the replaceable panels may be 2 or 3 feet wide. The distance between the connect straps 56, 57 or ties 65, 66 depend primarily upon the rough usage anticipated. It is thought that the maximum spacing would be to provide a strap or tie at the corners and every 20 feet therebetween. The embodiment of FIG. 4 would be preferred only if the anticipated usage is so rough that fasteners must be closer together than, say, 1-foot intervals.

Figure 6:
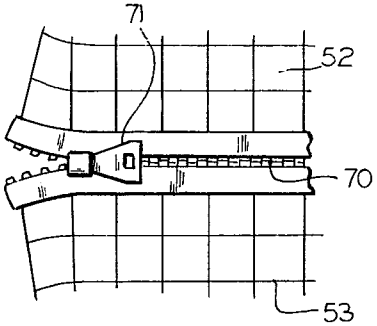
FIG. 6 is another fragmentary view of yet another embodiment using a zipper as a fastener means.

FIG. 6 shows yet another embodiment wherein the upper net part 52 is attached to the lower panel 53, by means of zipper 70, closed by a slide 71. This embodiment is recommended only when the substantial costs of a zipper can be justified by its particular characteristics, as compared to the costs and characteristics of the other embodiments.

It is also anticipated that in some installations, the bottom panel 53 may be a more solid material than a pure netting. This would be where the players are not likely to step on or collide with the net, as at the back of a court or where the divider net is a substantial distance away from the side lines of the court. Solid panels may also be used where small balls are used.

Those who are skilled in the art may readily perceive how modifications may be made. Therefore, the appended claims are to be construed broadly enough to cover all equivalent structures.

I claim:

1. A divider net having an upper portion and an easily replaceable lower panel, means for attaching the lower panel to the upper portion by fasteners, whereby said panel may be replaced on site, preferably without having to remove the upper portion from its support, and an additional plurality of means for periodically binding the upper portion to the panel at spaced points distributed along substantially the entire length of the nets where they are joined together by said attaching means.

2. A divider net having an upper portion and an easily replaceable lower panel, means for attaching the lower panel to the upper portion by fasteners, the attaching means comprising hook and loop strips fastened along the length of the bottom of said upper portion and the top of said replaceable panel, whereby said panel may be replaced on site, preferably without having to remove the upper portion from its support, and means for binding the upper portion to the panel at spaced points along the length of the nets where they are joined together by said attaching means said binding means comprising connect straps wrapped around said strips.

3. The divider net of claim 2 wherein said connect straps include snap fasteners for securing them in place around said strips.

4. A divider net having an upper portion and an easily replaceable lower panel, means for attaching the lower panel to the upper portion by a strip fastener, said attaching means comprising lacing adjacent said strip and running longitudinally along the length of the net where the upper portion joins the panel, whereby said panel may be replaced on site, preferably without having to remove the upper portion from its support, and means for binding the upper portion to the panel at spaced points along the length of the nets where they are joined together by said attaching means.

5. The divider net of claim 1 wherein the attaching means is a zipper.

6. A divider net having an upper portion and an easily replaceable lower panel, means for attaching the lower panel to the upper portion by fasteners, whereby said panel may be replaced on site, preferably without having to remove the upper portion from its support, and means for binding the upper portion to the panel at spaced points along the length of the nets where they are joined together by said attaching means, said binding means comprising periodic ties adjacent the bottom of the upper portion and the top of said panel for securing them together.

7. A divider net having an upper portion and an easily replaceable lower panel, a plurality of clip fasteners along the top edge of said upper portion for clipping said upper portion over a cable, means for attaching the lower panel to the upper portion by fasteners, whereby said panel may be replaced on site, preferably without having to remove the upper portion from said cable, and means for binding the upper portion to the panel at spaced points along the length of the nets where they are joined together by said attaching means.

8. The divider net of claim 1 wherein said net is approximately as long as one-half the length of a tennis court.

9. A space dividing system for use between adjacent tennis courts, said system comprising a cable, a predetermined height above the tennis court surface, stretched approximately mid-way between and along the length of said adjacent tennis courts, a first net portion having a width which is less than said predetermined height, a plurality of fasteners spaced along the top portion thereof for sliding attachment of said first net portion to said cable, a first half of a fastener means running along substantially the entire length of the bottom edge of said first net portion, a panel having a width which may be added to the width of said first net portion to at least equal the predetermined height of said cable above said surface of said tennis court, and a second half of said fastener means running along substantially the entire length of the top edge of said panel, said first and second halves of said fastener means having mating characteristics for joining said panel to said first net portion.

10. The system of claim 9 wherein said fastener means are mating strips of hook and loop material.

11. The system of claim 10 and a plurality of supplemental fastening means surrounding said strips of hook and loop material.

12. The system of claim 11 wherein each of said supplemental fastening means comprises a connect strap having mating snap fasteners on the ends thereof.

13. The system of claim 11 wherein each of said supplemental fastening means comprises a pair of opposed ties attached to said first net portion and said panel, respectively.

14. The system of claim 9 wherein the combined widths of said first net portion and said panel exceed the height of said cable above said tennis court surface, whereby said combined widths hang down and drape upon said floor.

15. The system of claim 14 wherein said first net portion and said panel have a length approximately equal to one-half the length of a tennis court.

16. The system of claim 9 wherein said fastener means is a zipper.

* * * * *